US006725949B2

(12) United States Patent
Seneviratne

(10) Patent No.: US 6,725,949 B2
(45) Date of Patent: Apr. 27, 2004

(54) WASHPIPE ASSEMBLY

(75) Inventor: Padmasiri Daya Seneviratne, Fullerton, CA (US)

(73) Assignee: Varco I/P, Inc., Orange, CA (US)

( * ) Notice: Subject to any disclaimer, the term of this patent is extended or adjusted under 35 U.S.C. 154(b) by 0 days.

(21) Appl. No.: 10/229,948

(22) Filed: Aug. 27, 2002

(65) Prior Publication Data

US 2003/0051883 A1 Mar. 20, 2003

Related U.S. Application Data

(60) Provisional application No. 60/315,072, filed on Aug. 27, 2001.

(51) Int. Cl.[7] ..... E21B 19/06
(52) U.S. Cl. ..... 175/85; 175/113; 175/121
(58) Field of Search ..... 175/57, 85, 113, 175/121, 122, 203, 207, 214, 216

(56) References Cited

U.S. PATENT DOCUMENTS

| | | | | |
|---|---|---|---|---|
| 1,432,109 | A | | 10/1922 | King |
| 2,185,822 | A | | 1/1940 | Young |
| 2,253,932 | A | | 8/1941 | Gilkerson |
| 2,394,800 | A | | 2/1946 | Murphy |
| 2,459,472 | A | | 1/1949 | Tremolada |
| 2,608,385 | A | | 8/1952 | Stahl |
| 2,770,475 | A | | 11/1956 | Rafferty |
| 3,736,007 | A | * | 5/1973 | Heilhecker et al. ..... 285/31 |
| 3,752,507 | A | | 8/1973 | Maurer et al. |
| 3,929,340 | A | | 12/1975 | Peisker |
| 4,299,416 | A | | 11/1981 | Grosch |
| 4,449,738 | A | | 5/1984 | Hotger |
| 4,574,893 | A | * | 3/1986 | Young et al. ..... 175/170 |
| 4,754,780 | A | | 7/1988 | Smith, III |
| 4,890,681 | A | | 1/1990 | Skelly |
| 4,984,641 | A | * | 1/1991 | Pryor ..... 175/170 |
| 5,052,720 | A | | 10/1991 | Yoda |
| 5,388,651 | A | * | 2/1995 | Berry ..... 175/85 |
| 6,007,105 | A | * | 12/1999 | Dietle et al. ..... 285/94 |
| 6,527,048 | B1 | | 3/2003 | Trosclair |

OTHER PUBLICATIONS

International Search Report for International Application No. PCT/US02/27432 dated Oct. 31, 2003.

* cited by examiner

*Primary Examiner*—Frank Tsay
(74) *Attorney, Agent, or Firm*—Christie, Parker & Hale, LLP

(57) ABSTRACT

A drilling system and a method of using a drilling system that has a first rotatable tubular connector, a second non-rotatable tubular connector and a washpipe assembly having at least one dynamic seal and defining a fluid conduit having at one end a first mating connector and at another end a second mating connector designed to interconnect with the first and second tubular connectors. A controllable torque driver is arranged to mechanically engage the washpipe assembly such that fluid connections are made between the first mating connector and the first tubular connector, and the second mating connector and the second tubular connector.

34 Claims, 11 Drawing Sheets

FIG. 9C
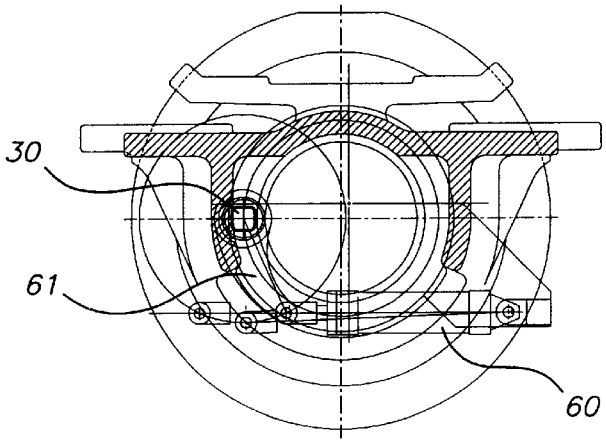
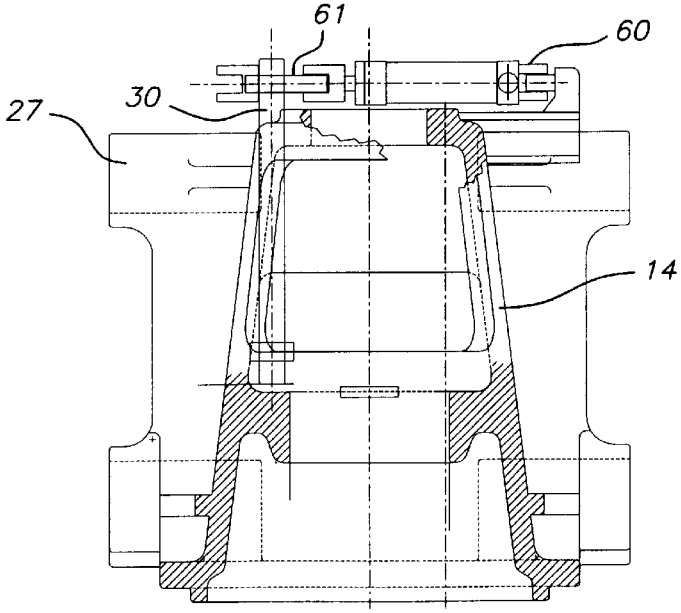
FIG. 9A
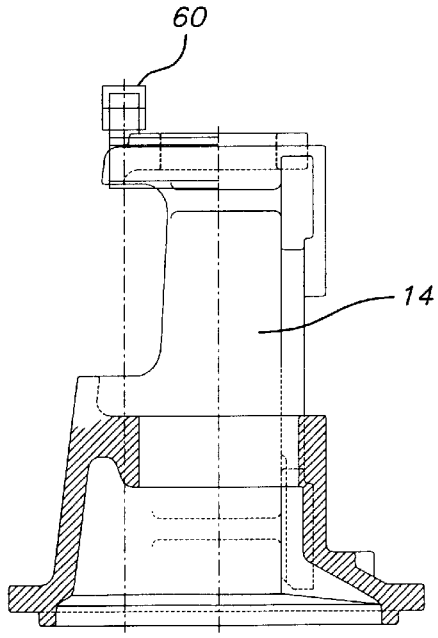
FIG. 9B

FIG. 10C
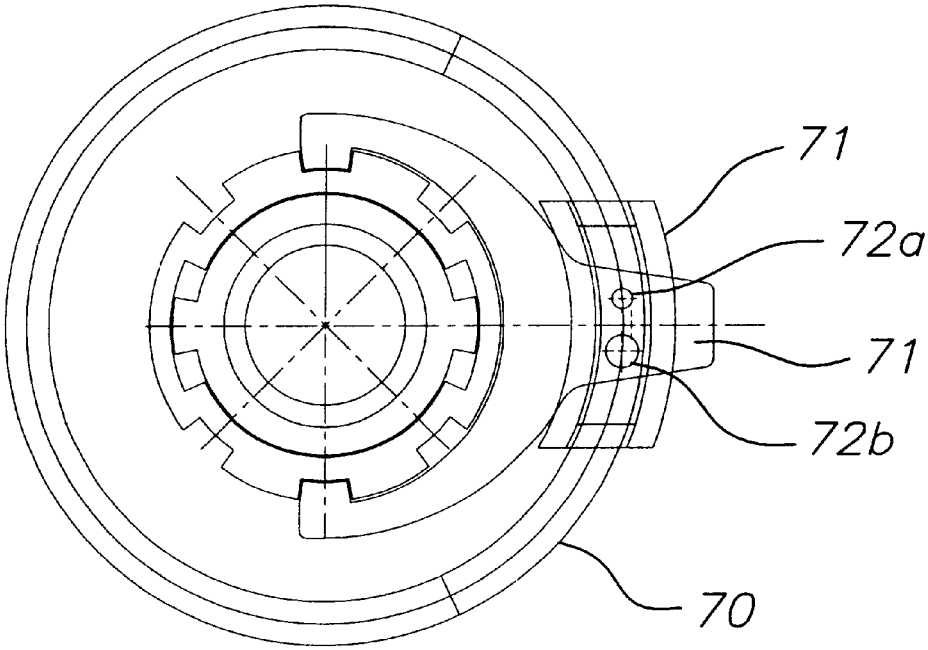
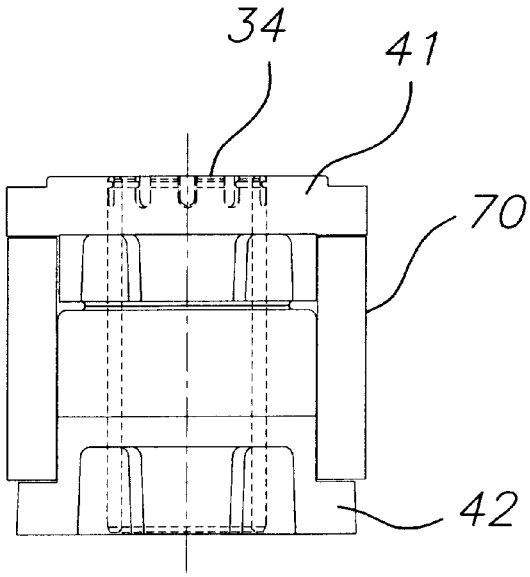
FIG. 10B

WASHPIPE ASSEMBLY

CROSS-REFERENCE TO RELATED APPLICATION(S)

This application claims priority under 35 U.S.C. §119(e) to U.S. Provisional Application Ser. No. 60/315,072, filed Aug. 27, 2001.

FIELD OF THE INVENTION

The invention relates generally to equipment useful in earth boring operations performed by a rotary drilling system and specifically to an improved portion of a rotary drilling system that allows for safe and convenient maintenance of the washpipe dynamic seals that are subject to heavy wear during drilling operations. More specifically, the present invention contemplates an improved washpipe assembly apparatus and a method for installing and removing the same.

BACKGROUND OF THE INVENTION

A top drive well drilling apparatus typically includes a top drive system (TDS) connectable to the upper end of a drill string to drive the drill string rotatively and which moves upwardly and downwardly with the string during the drilling operation. The TDS includes a tubular main shaft, the lower end of which is threadedly connectable to the upper end of the drill string and through which drilling mud is delivered downwardly to the string and drill bit from a gooseneck and swivel assembly at the upper end of the unit. The unit further includes a motor to drive the main shaft rotatively as the well is drilled. A washpipe assembly comprising at least one dynamic seal and a tubular element is threadedly connected between the top of the main shaft and the bottom of the gooseneck/swivel assembly.

The washpipe assembly is located above the rotating TDS main shaft and below the stationary gooseneck. Drilling mud is pumped at high pressure through the gooseneck and washpipe assembly and into the main shaft. The dynamic seals of the washpipe assembly act as the main sealing elements between the connection of the washpipe assembly to each of the TDS main shaft and the gooseneck. During drilling operations these dynamic seals experience extreme wear and require frequent replacement.

Replacement of the dynamic seals requires an operator to disengage the connection of the washpipe assembly with each of the main shaft and the swivel/gooseneck, to remove the washpipe assembly and to install a replacement washpipe assembly. Installation and removal of the washpipe assembly are each accomplished in a similar manner. In conventional systems, both operations typically involve manually striking a nut that threadedly connects the washpipe assembly to the main shaft and manually striking a nut that threadedly connects the washpipe assembly to the swivel/gooseneck assembly. The manually striking is typically accomplished by a sledgehammer, thereby imparting an impact torque to either engage or disengage the nuts. Repeated application of such impact torque may be necessary, particularly when the connection must be disengaged after extended exposure to the extreme stresses and environmental conditions of the drilling environment. In the best of circumstances, this operation is unsafe and time-consuming. Moreover, because the torque applied is uncontrolled, i.e. not measured, a determination of whether the nuts of the washpipe assembly are fully engaged or disengaged is left to the judgement of the operator that is installing or removing the washpipe assembly. Thus, increasing the likelihood of operator error and subsequent damage to the rig.

Accordingly, a need exists for a new apparatus and method for installing a washpipe assembly in a safe and controlled manner.

SUMMARY OF THE INVENTION

The present invention provides a drilling apparatus designed to allow for the controlled, i.e. measured, application of torque to a washpipe assembly during installation of the washpipe assembly to each of a main shaft and a gooseneck. In one embodiment, the washpipe assembly generally comprises a washpipe fluid conduit, at least one dynamic seal, a gooseneck geared nut mating connector for threadedly connecting the washpipe assembly to a stationary gooseneck connector, and a packing box geared nut mating connector for threadedly connecting the washpipe assembly to a rotatable main shaft connector. In addition, a torque driver is provided to apply a suitable torque to each of the mating connectors of the washpipe assembly to sealingly interconnect the washpipe assembly to the stationary gooseneck connector and to the rotatable main shaft connector. It has been found that this combination allows drilling mud to be pumped through the stationary gooseneck, the washpipe assembly, the rotating main shaft, the drill stem, the drill string and the drill bit during drilling operations.

Although any suitable dynamic seal may be utilized in the present invention, in one embodiment the dynamic seal is designed to provide a fluid seal between the washpipe assembly and each of the threaded connections of the gooseneck and the main shaft. For example, the dynamic seals may comprise an elastomeric o-ring type seal.

In one alternative embodiment, the torque driver comprises an drive shaft housing mounted on a side of a washpipe bonnet and aligned in a manner roughly parallel to a longitudinal axis of the main shaft. In such an embodiment, the drive shaft housing partially encloses a drive shaft that is both slidable along and rotatable about its own axis. A torque transfer mechanism, such as a pinion gear is slidably affixed to a portion of the drive shaft that is interior to the washpipe bonnet. The pinion gear is disposed at a convenient vertical position along the drive shaft and secured thereto by a fastener such as, for example, a thumb screw. The drive shaft may have any convenient cross section, such as square, rectangular, triangular or pentagonal, among other cross sections. Likewise, any torque transfer mechanism suitable for transferring an externally applied torque to the washpipe assembly, such as a drive rod or chain linkage may be utilized.

In yet another exemplary embodiment, the torque driver comprises an optional torque multiplier and a manual torque wrench attached thereto. In such an embodiment, torque is applied manually through the torque wrench. Although a manual drive system is described above, any drive system capable of controllably and reproducibly applying a specified torque to the mating connections of the washpipe assembly may be utilized. An exemplary alternative embodiment includes a drive shaft with a torque drive motor having a coupling. For example, the torque drive motor may be an air motor, a hydraulic motor or an electric motor. Another exemplary alternative embodiment includes a hydraulic cylinder having a connective means. A further exemplary alternative embodiment includes a torqueing sleeve and the TDS main motor.

In still another exemplary embodiment, an optional bracket adjacent the washpipe bonnet allows a washpipe positioning mechanism to be rotatably connected to the washpipe bonnet to move the washpipe assembly into and out of an opening in the washpipe bonnet.

In still yet another embodiment, the present invention is directed to a method of installing and removing a washpipe assembly from a drill rig. In one such embodiment, the method involves engaging and disengaging the threaded connections between the washpipe assembly and each of the gooseneck and the main shaft, utilizing the washpipe assembly described above.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIG. 9*a* is a front sectional view of a washpipe bonnet with optional hydraulic drive mechanism installed according to one embodiment of the present invention.

FIG. 9*b* is a side sectional view of the washpipe bonnet the optional hydraulic drive mechanism of FIG. 9*a*.

FIG. 9*c* is a top sectional view of the washpipe bonnet with optional hydraulic drive mechanism of FIG. 9*b*.

FIG. 10*b* is a side view of the washpipe bonnet and the gooseneck assembly with the optional torqueing sleeve of FIG. 10*a*.

FIG. 10*c* is a top view of the washpipe bonnet and the gooseneck assembly with the optional torqueing sleeve of FIG. 10*a*.

DETAILED DESCRIPTION OF THE INVENTION

The present invention provides a drilling apparatus designed to allow for a controlled application of torque to a washpipe assembly. The invention is also directed to a method of utilizing the drilling apparatus of the present invention to controllably engage and disengage the threaded connections between the washpipe assembly and each of the swivel/gooseneck assembly and the main shaft of the drilling apparatus.

Figure 1:
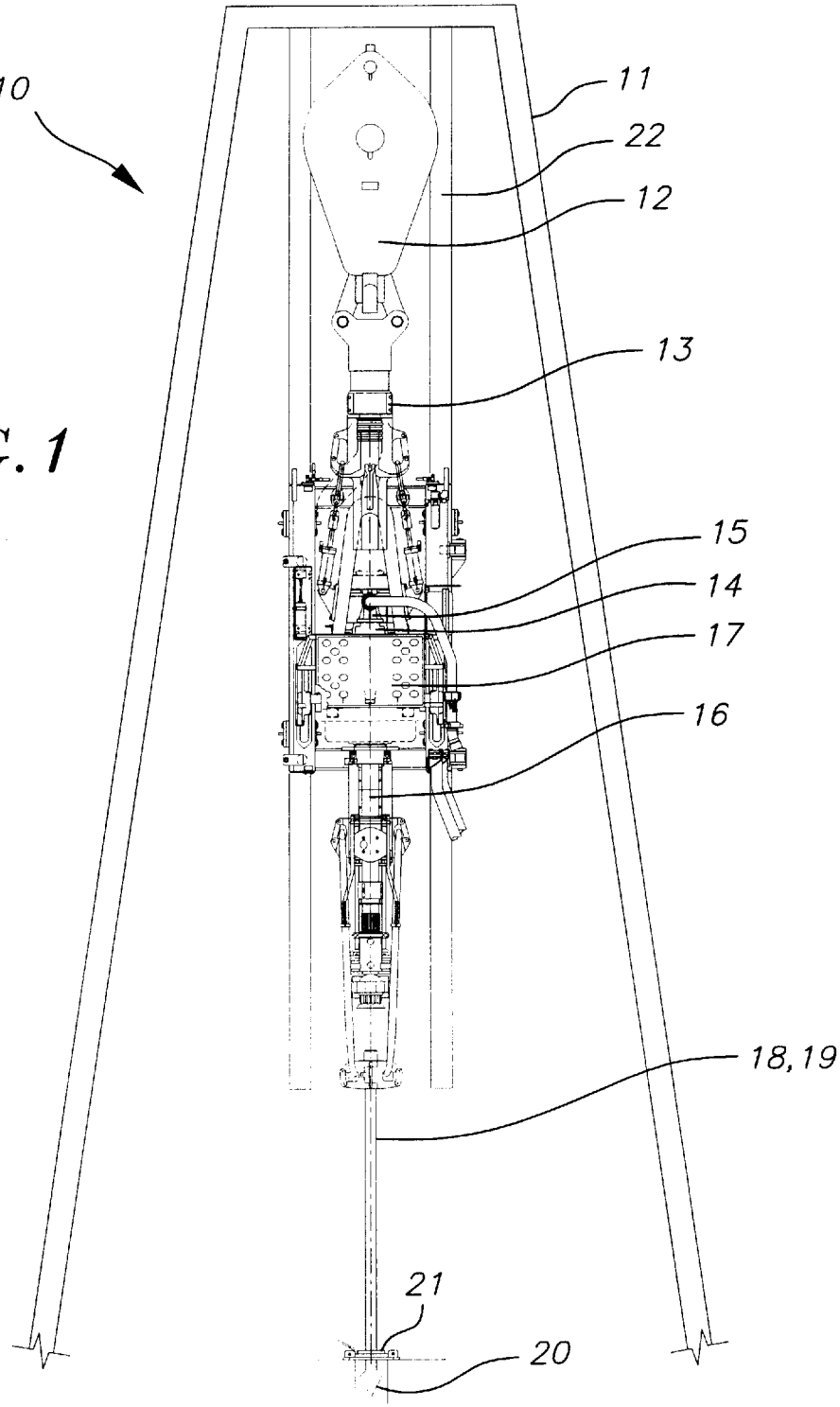
FIG. 1 is a schematic of a top drive drilling apparatus according to one embodiment of the present invention.

FIG. 1 illustrates a typical top drive well drilling apparatus 10. The drilling apparatus 10 is structurally supported by a derrick 11. The drilling apparatus 10 comprises a plurality of mechanical components including: a swivel 13, a washpipe bonnet 14, a gooseneck 15 that extends from the washpipe bonnet 14, a main shaft 16, a motor housing 17, a drill stem 18/drill string 19 and a drill bit 20. The mechanical components are collectively suspended from a traveling block 12 that allows the mechanical components to move upwardly and downwardly on rails 22 connected to the derrick 11 for guiding the vertical motion of the mechanical components. The swivel 13 is rotatably attached to the washpipe bonnet 14. The washpipe bonnet 14 is rotatably attached to the main shaft 16 through a washpipe assembly (not shown) that includes a dynamic seal (not shown). The main shaft 16 extends through the motor housing 17 and connects to the drill stem 18. The drill stem 18 is typically threadedly connected to one end of a series of tubular members collectively referred to as the drill string 19. An opposite end of the drill string 19 is threadedly connected to a drill bit 20.

During operation, a TDS motor encased within the motor housing 17 rotates the main shaft 16 which, in turn, rotates the drill stem 18/drill string 19 and the drill bit 20. Rotation of the drill bit 20 produces an earth bore 21. Fluid pumped into the gooseneck 15 passes through the main shaft 16, the drill stem 18/drill string 19, the drill bit 20 and enters the bottom of the earth bore 21. Cuttings removed by the drill bit 20 are cleared from the bottom of the earth bore 21 as the fluid pumped into the gooseneck 15 passes out of the earth bore 21 through an annulus formed by the outer surface of the drill bit 20 and the walls of the bore 21.

Although a washpipe assembly according to the present invention will be described throughout in relation to its use and operation in a top drive drilling rig environment, it should be understood that a similar mechanism may be easily adapted for use in any environment which requires the application of controlled torque to a dynamic sealing fluid conduit.

Figure 2:
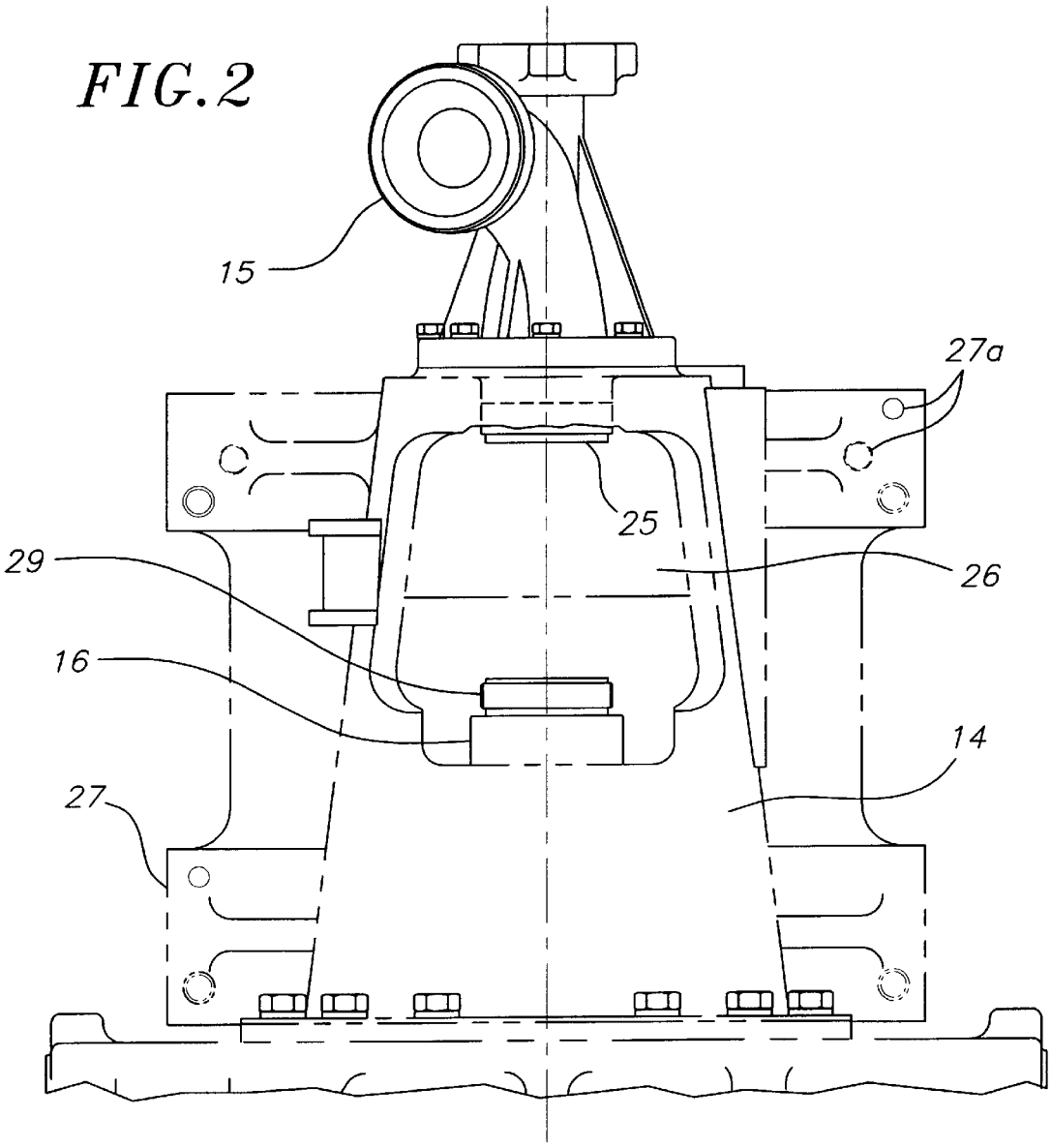
FIG. 2 is a schematic of an embodiment of a washpipe bonnet configuration according to one embodiment of the present invention, having a gooseneck assembly attached thereon.

FIG. 2. shows a detailed schematic of the washpipe bonnet 14 having the gooseneck 15 attached thereto. The washpipe bonnet 14 comprises a body which is generally cylindrical or bell-shaped and formed with a bonnet opening 26 on its vertical portion that is large enough to admit a washpipe assembly (not shown) inserted therein. The top and bottom of the washpipe bonnet 14 are generally planar with openings that allow drilling mud to flow down from the gooseneck 15, through the bonnet opening 26 to the main shaft 16. The gooseneck 15 may be integral to the bonnet 14 or removably mounted on the top planar portion of the bonnet 14. Similarly, the main shaft 16 may be integral to the bonnet 14 or removably mounted on the bottom planar portion of the bonnet 14. Two tubular fluid connections are provided within the bonnet opening 26: a threaded gooseneck connection 25, which may be integral to the gooseneck 15 or the washpipe bonnet 14 or a separate piece removably connected to the gooseneck 15 or washpipe bonnet 14; and a threaded main shaft connection 29 which is typically an integral portion of the main shaft, threaded at an end of the main shaft 16 that is nearest to the gooseneck 15, but may also be a separate piece removably connected to the main shaft 16.

Figure 3:
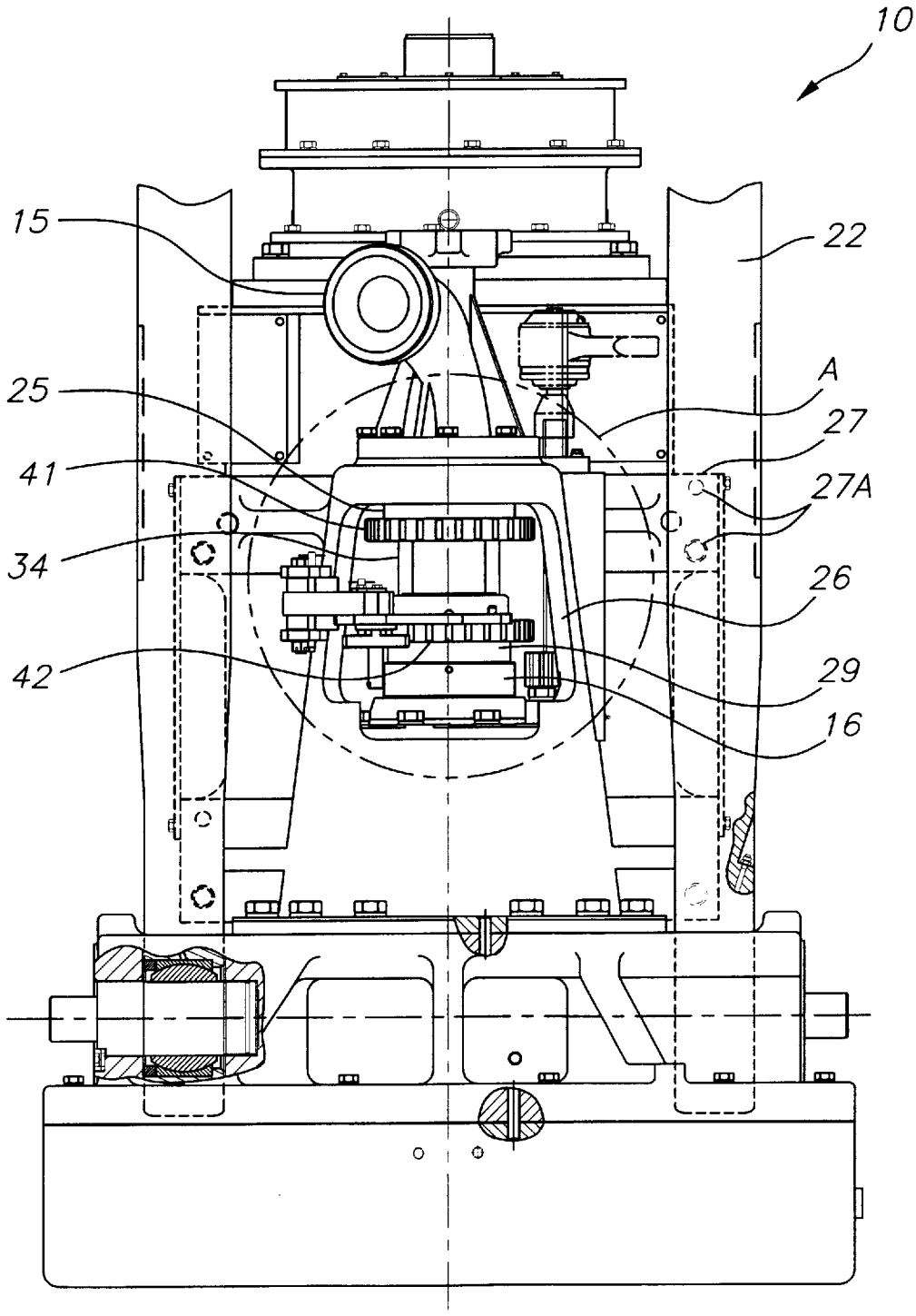
FIG. 3 is a frontal view of the washpipe bonnet and the gooseneck assembly of FIG. 2, having a washpipe assembly according to one embodiment of the present invention installed within the washpipe bonnet.

The washpipe bonnet 14 may further comprises a planar mounting plate 27 which may be an integral part of the washpipe bonnet 14 or a separate piece fixedly attached thereto. The planar mounting plate 27 is provided with mounting holes 27*a* which allow the washpipe bonnet 14 to be fixedly connected to the motor housing 17 (as shown in FIGS. 2 and 3) using one or more fasteners. The washpipe bonnet 14 may further comprise an optional mounting bracket 28 to allow a mechanism for assisting in the insertion and removal of the washpipe assembly (not shown) to be rotatably attached thereto.

Although the washpipe bonnet 14 has been described above as having a bell shape, it should be understood that any washpipe bonnet 14 configuration that allows a washpipe assembly according to the present invention to be inserted between two fluid connectors, such as the gooseneck 15 and the main shaft 16, to provide a dynamically sealing fluid conduit therebetween may be used.

FIGS. 3 to 6 show a variety of views of a washpipe assembly 34 according to the present invention and the washpipe bonnet 14 assembled on a drilling rig. For example detail A of FIG. 3 shows the connection of the washpipe assembly 34 according to the present invention within the washpipe bonnet 14 of a drilling rig.

Figure 5:
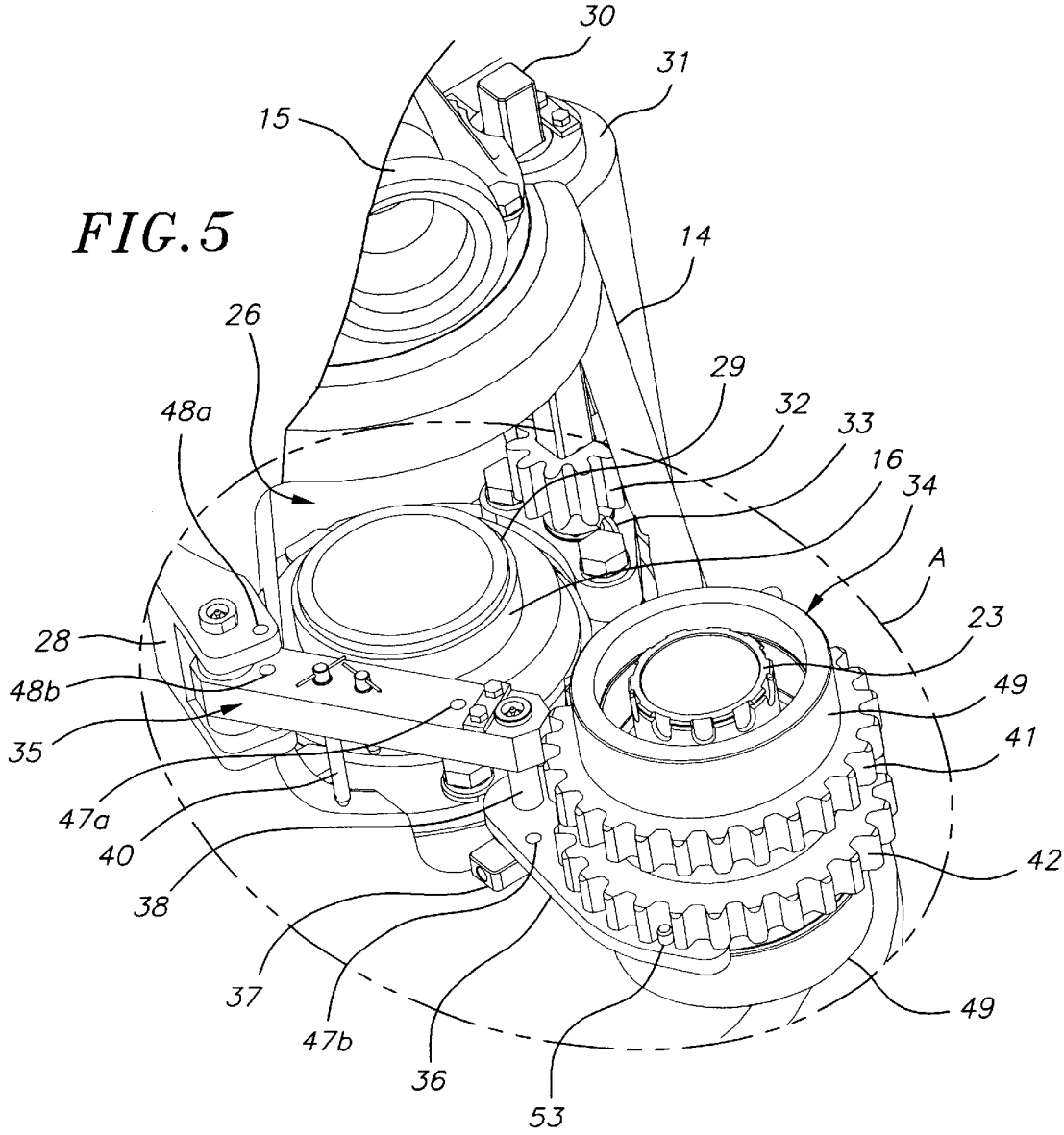
FIG. 5 is a perspective view of the washpipe assembly of FIG. 3 in an uninstalled position.
Figure 6:
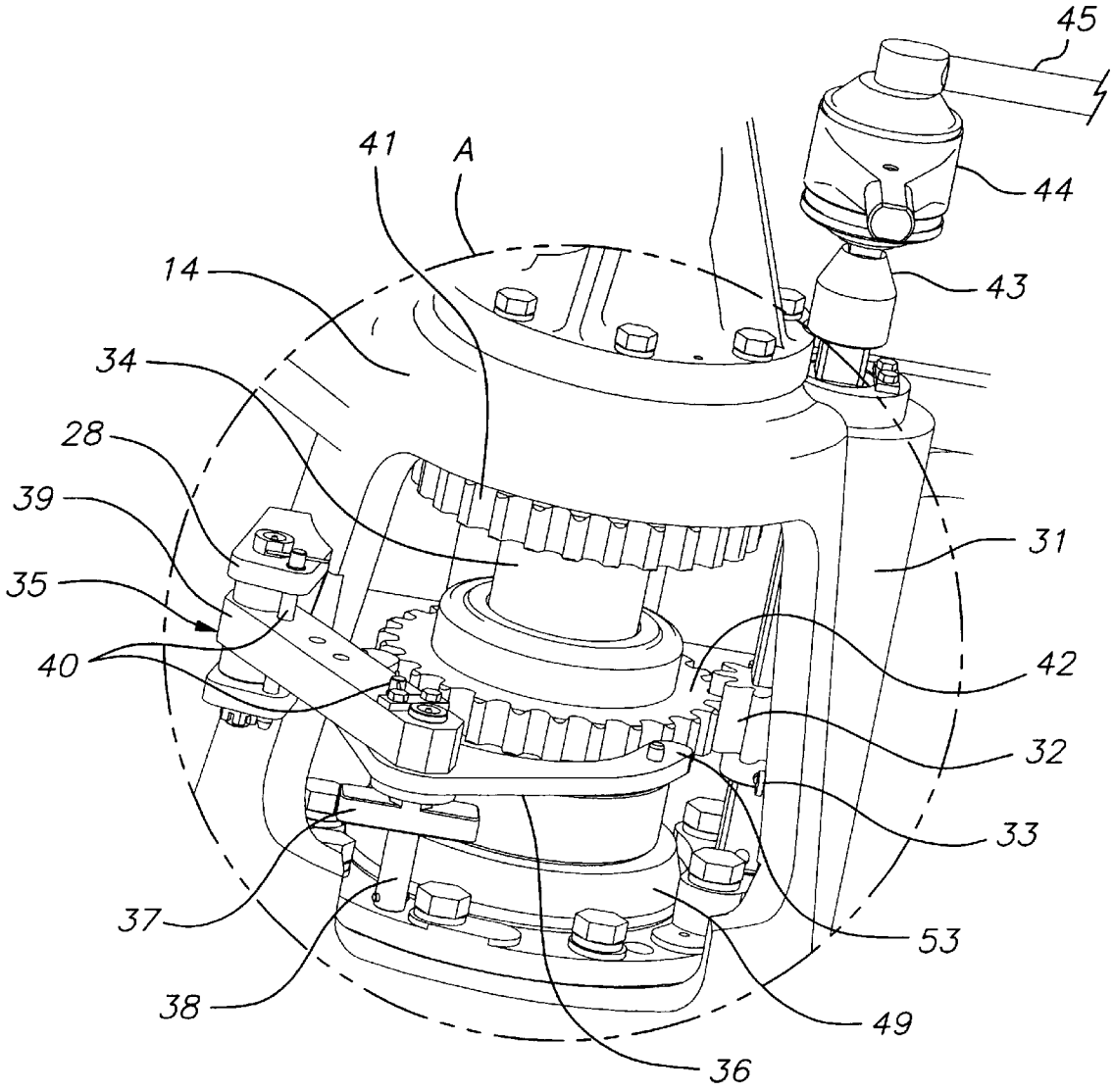
FIG. 6 is a perspective view of the washpipe assembly of FIG. 3 in an installed position.
Figure 7E:
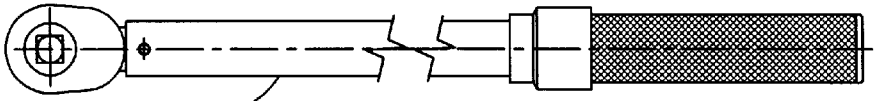
FIG. 7*e* is a top view of an optional torque wrench according to one embodiment of the present invention.
Figure 7F:
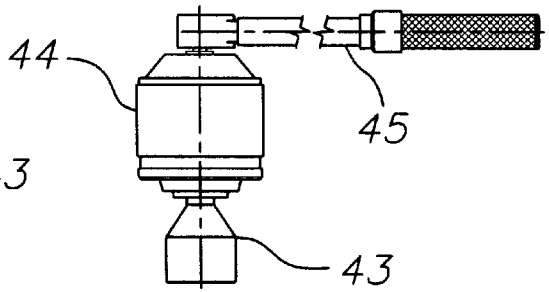
FIG. 7*f* is a side view of an assembled comprising the optional torque wrench of FIG. 7*e*, the optional torque multiplier of FIG. 7*a* and the socket adapter of FIG. 7*c*.
Figure 7D:
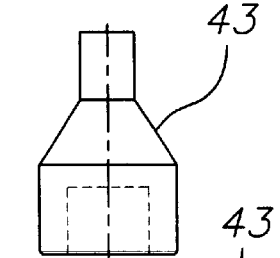
FIG. 7*d* is a side view of the optional socket adapter of FIG. 7*c*.
Figure 7C:
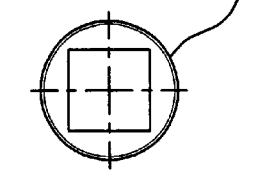
FIG. 7*c* is a top view of an optional socket adapter according to one embodiment of the present invention.
Figure 7B:
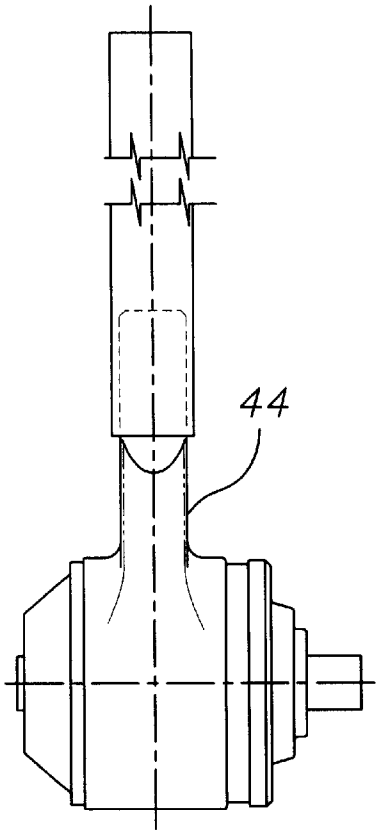
FIG. 7*b* is a side view of the optional torque multiplier of FIG. 7*a*.
Figure 7A:
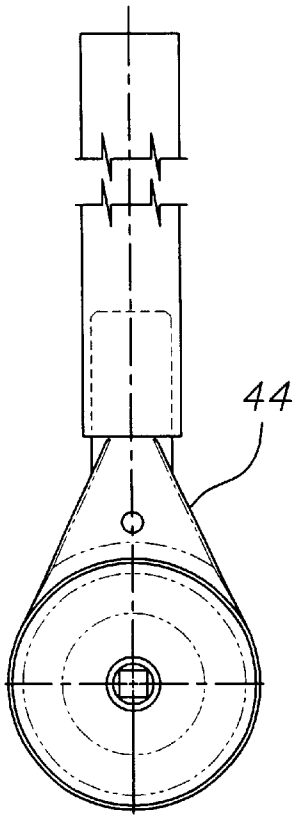
FIG. 7*a* is a front view of an optional torque multiplier according to one embodiment of the present invention.

FIGS. 5 and 6 show enlarged views of detail A, wherein an embodiment of the washpipe assembly 34 shown in installed and uninstalled configurations, respectively. As shown in FIG. 5, the washpipe assembly 34 comprises a fluid conduit 23 that forms a fluid connection between each of the gooseneck 15 and the main shaft 16 when the washpipe assembly 34 is connected to each of the gooseneck 15 and the main shaft 16.

Referring to any of FIGS. 3 to 6, the washpipe assembly 34 generally comprises the washpipe fluid conduit 23, at least one dynamic seal 49, a gooseneck geared nut mating connector 41 for threadedly connecting the washpipe assembly 34 to the threaded gooseneck connection 25 of the stationary gooseneck 15, and a packing box geared nut mating connector 42 for threadedly connecting the washpipe assembly 34 to the threaded main shaft connection 29 of the rotatable main shaft 16. When the washpipe assembly 34 has been installed, as show in FIG. 6, the packing box nut 42 is threadedly connected to the threaded main shaft connection 29 of the main shaft 16 and the gooseneck nut 41 is threadedly connected to the threaded gooseneck connection 25 of the gooseneck 15, such that a fluid connection is formed between the washpipe assembly 34 and each of the gooseneck 15 and the main shaft 16 through the dynamic seals 49 between the washpipe assembly 34 and each of the rotatable mainshaft 16 and the stationary, i.e., non-rotatable gooseneck 15. This combination allows drilling mud to be pumped through the stationary gooseneck 15, the washpipe assembly 34, the rotating main shaft 16, the drill stem 18/the drill string 19 (FIG. 1) and the drill bit 20 (FIG. 1) during drilling operations.

As shown in FIGS. 5 and 6, the dynamic seal 49 is designed to provide a fluid seal between the washpipe assembly 34 and the threaded connections of the washpipe assembly 34 to each of the gooseneck 15 and the main shaft 16. A number of types of dynamic seals 49 suitable for fluidly connecting a rotatable tubular member to a non-rotatable tubular member are known in the art. For example, the dynamic seals 49 may be elastomeric O-ring type seals. In some embodiments, the seal connecting the washpipe assembly 34 to the gooseneck 15 may be a typical O-ring and does not need to be a dynamic seal.

In the embodiment shown in FIGS. 5 and 6, an integral cylindrical drive shaft housing 31 partially protrudes from a side of the washpipe bonnet 14, for example between the bonnet opening 26 and the mounting plate 27, and is aligned in a manner generally parallel to the longitudinal axis of the main shaft 16. In the embodiment shown in FIGS. 5 and 6, the drive shaft housing 31 partially encloses a drive shaft 30, which is both slidable along and rotatable about its own axis. The drive shaft 30 extends above the drive shaft housing 31 into the external environment and below the drive shaft housing 31 into the interior of the washpipe bonnet 14. A torque transfer mechanism, such as a pinion gear 32 is slidably affixed to the portion of the drive shaft 30 that extends into the interior of the washpipe bonnet 14. The pinion gear 32 is disposed at a convenient vertical position along the drive shaft 31 and secured thereto by a fastener such as, for example, a thumb screw 33. In such an embodiment, the pinion gear 32 may comprise a collar having an opening for receiving the thumb screw 33, such that the thumb screw 33 fixes the position of the pinion gear 32 relative to the drive shaft 30.

Although the drive shaft 30 is shown in FIGS. 5 and 6 as having a square cross section, those skilled in the art will immediately recognize that the drive shaft 30 may have any convenient cross section. For example, the drive shaft 30 may have a cross section that is rectangular, triangular or pentagonal, among other configurations. Likewise, although the embodiment shown in FIGS. 5 and 6 show the torque transfer mechanism 32 as comprising the pinion gear 32, any mechanism suitable for transferring an externally applied torque to the nuts 41 and 42 of the washpipe assembly 34, such as a drive rod or chain linkage may be used.

Several means are contemplated for applying torque to the drive shaft 30. For example, FIGS. 5 and 6 illustrate the drive shaft 30 with an optional torque multiplier 44 and a manual torque wrench 45 attached thereto. In this embodiment, the torque may be applied manually through the torque wrench 45, through the optional torque multiplier 44 and to the drive shaft 30 and its attached pinion gear 32. In such an embodiment, the torque that is applied to the drive shaft 30 may be controlled, i.e. measured, by the torque settings on the torque wrench 45/multiplier 44 in a conventional fashion. FIGS. 7*a* to 7*f* how schematics of one embodiment of a suitable torque wrench 45, torque multiplier 44, and a socket adapter 43 utilized in such a drive system.

Figure 8:
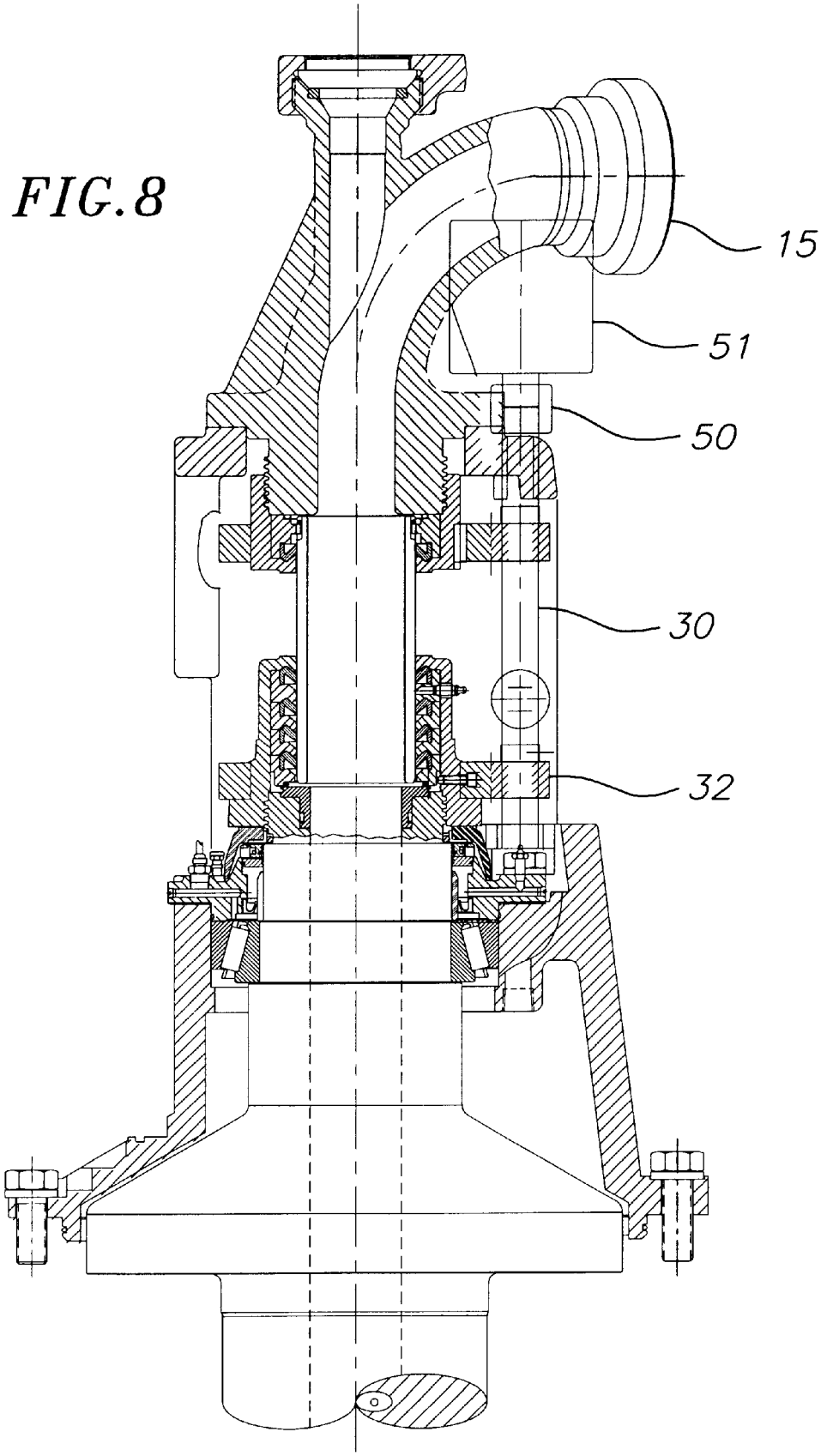
FIG. 8 is a sectional view of one embodiment of a washpipe assembly and washpipe bonnet with gooseneck assembly along with an optional motorized drive mechanism according to one embodiment of the present invention.
Figure 10A:
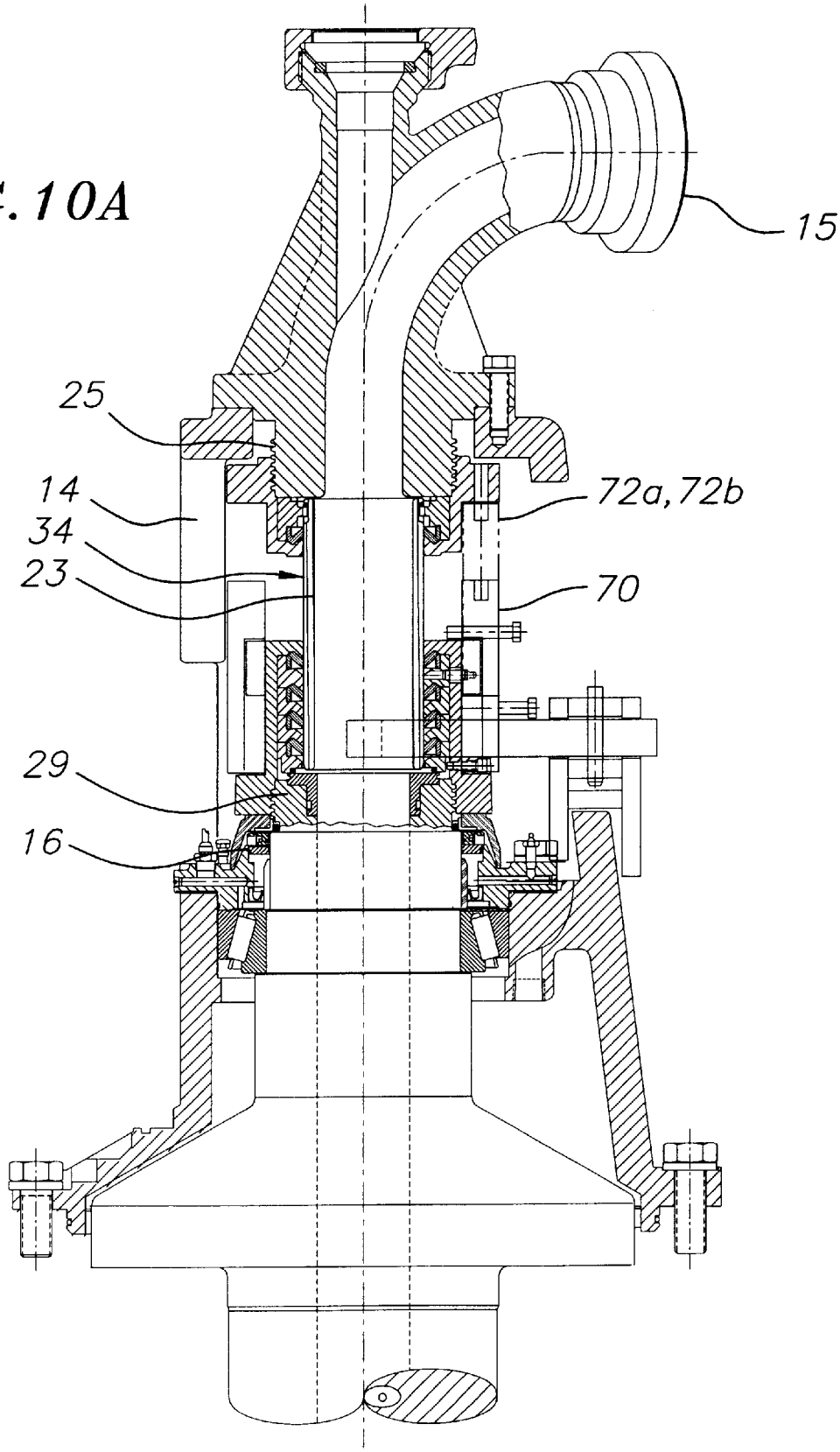
FIG. 10*a* is a side sectional view of a washpipe bonnet and gooseneck assembly as adapted for use with an optional torqueing sleeve according to one embodiment of the present invention.

Although a manual drive system is described above, any drive system capable of controllably and reproducibly applying a specified and reproducible torque to the nuts 41 and 42 of the washpipe assembly 34 through the pinion gear 32 may be utilized. Some exemplary alternative embodiments are presented in FIGS. 8 to 10. For example, FIG. 8 illustrates the drive shaft 30 with an optional torque drive motor 50 and a coupling 51. In such an embodiment, the motor 50 may be any motor capable of providing suitable torque to the nuts 41 and 42 of the washpipe assembly 34 through the pinion gear 32, such as, an air motor, a hydraulic motor or an electric motor. FIGS. 9A to 9C depict another embodiment that utilizes a hydraulic cylinder 60 and a connective means 61 to apply torque to the drive shaft 30. FIGS. 10A to 10C illustrate an embodiment utilizing a torqueing sleeve 70 and the TDS main motor to apply torque to the drive shaft 30, to engage and disengage the threaded connections between the washpipe assembly 34 and the threaded gooseneck connection 25 of the gooseneck 15 and the threaded main shaft connection 29 of the main shaft 16.

As shown in FIGS. 5 and 6, although the washpipe assembly 34 may be inserted into the bonnet opening 26 by hand, the optional bracket 28, which is adjacent to the bonnet opening 26 in the washpipe bonnet 14, may be used to allow a washpipe positioning mechanism 35 to be rotatably connected to the bonnet 14. In the embodiment shown in FIGS. 5 and 6, the washpipe positioning mechanism 35 comprises a pivot link 39 rotatably connected at one end to the bracket 28 and rotatably connected to a positioning yoke 36 at the opposite end. The pivot link 39 and the positioning yoke 36 each rotate in planes roughly perpendicular to the axis of the main shaft 16. The rotatable connection between positioning yoke 36 and the pivot link 39 includes a jack nut 37 and a jack screw 38 that combine to allow the positioning yoke 36 to move vertically along a path defined by the length of the jack screw 38 and generally perpendicular to the plane in which the positioning yoke 36 is free to rotate.

In the embodiment shown in FIGS. 5 and 6, the positioning yoke 36 is a thin and generally U-shaped mechanism with a semicircular opening adapted to fit around a section of the washpipe assembly 34 just below the geared portion of the packing box geared nut 42. Two small dowel pins 53 extend upward from the plane that defines the top surface of the positioning yoke 36. The dowel pins 53 are located in positions that allow the dowel pins 53b to be disposed between the teeth of the packing box geared nut 42 to stabilize the washpipe assembly 34 as it is swung into the bonnet opening 26, such that the washpipe assembly 34 is in a washpipe assembly connecting position (FIG. 5) and out of the bonnet opening 26, such that the washpipe assembly 34 is in a disengaged or a washpipe assembly replacement position (FIG. 6) by the rotational motion of each of the pivot link 39 and the positioning yoke 36. Aligning holes 48*a* and 48*b* drilled vertically through the bracket 28 and the pivot link 39, respectively, align at the washpipe assembly connecting position (as shown in FIG. 6). The pivot link 39 may be secured in the washpipe assembly connecting position by utilizing a storage pin 40 or other means that passes through the aligning holes 48*a* and 48*b* to lock the pivot link 39 against rotation. Similarly, aligning holes 47*a* and 47*b* are drilled vertically through the opposite end of the pivot link 39 and the positioning yoke 36, respectively, and align at the washpipe assembly connecting position, allowing the storage pin 40 or other means to pass through the aligning holes 47*a* and 47*b* to thereby secure the positioning yoke 36 in the washpipe assembly connecting position.

Although one washpipe positioning mechanism 35 is described above, it should be understood that any mechanism capable of securely moving the washpipe assembly 34 into and out of the bonnet opening 26 in the washpipe bonnet 14 either with or without attachment to the washpipe bonnet mounting bracket 28 may be used with the present invention.

Although the above description of the washpipe assembly 34 and torque driving mechanism generally describe an assembly comprising a pair of interlocking gears, it should be understood that any washpipe assembly 34 and any torque drive mechanism capable of interacting such that a specified amount of torque can be applied to engage or disengage the connections between the washpipe assembly 34 and each of the gooseneck 15 and main shaft 16 may be used according to the present invention.

The present invention is also directed to a method of installing and removing the washpipe assembly 34. More specifically, the method involves engaging and disengaging the threaded connections between the threaded gooseneck connection 25 of the gooseneck 15 and the gooseneck nut 41 of the washpipe assembly 34 and the threaded main shaft connection 29 of the main shaft 16 and the packing box nut 42 of the washpipe assembly 34.

A typical installation of the washpipe assembly 34 as shown in FIGS. 5 and 6 begins with a halting of the rotation of the main shaft 16, such as by a motor brake that is applied to the TDS motor to prevent rotation of the main shaft 16. After the rotation of the main shaft 16 has been stopped, the storage pins 40 that secure the pivot link 39 and the positioning yoke 36 in the washpipe assembly connecting position are removed, thereby freeing both mechanisms for rotation. The washpipe assembly 34 is placed on the positioning yoke 36 in such a manner that each of the dowel pins 35 is disposed between teeth of the packing box geared nut 42 to secure the washpipe assembly 34 on the positioning yoke 36 during the installation process. The washpipe assembly 34 is then moved to a position within the washpipe bonnet 14 just above the top of the main shaft 16 by rotating the positioning yoke 36 and the pivot link 39 to the washpipe assembly connecting position. The washpipe assembly 34 is then lowered onto the main shaft 16 by lowering the positioning yoke 36 via manipulation of the jack nut 37. The positioning yoke 36 is then rotated out of the interior of the washpipe bonnet 14.

Once the washpipe assembly 34 is positioned within the bonnet 14, rotation of the nuts 41 and 42 causes engagement of the threaded gooseneck connection 25 of the gooseneck 15 and the gooseneck nut 41 of the washpipe assembly 34 and the threaded main shaft connection 29 of the main shaft 16 and the packing box nut 42 of the washpipe assembly 34. Prior to tightening the threaded connections by applying torque from the torque drive mechanism through the drive shaft 30 and pinion gear 32 to the washpipe assembly 34, the gooseneck nut 41 and packing box nut 42 may optionally be manually engaged with the threaded connections 25 and 29, respectively, of the gooseneck 15 and main shaft 16. Manual engagement of either of nuts 41 or 42 entails rotating the nuts 41 or 42 by hand to threadedly connect it to its intended target connection.

After the nuts 41 and 42 have been engaged with the connections, 25 and 29 respectively, the nuts 41 and 42 can be tightened to an operational torque to properly engage the dynamic seals 49 of the washpipe assembly 34. Utilization of the torque drive mechanism through the drive shaft 30 and pinion gear 32 to tighten the geared nuts 41 and 42 to the desired working torque requires that the teeth of the pinion gear 32 be engaged with the teeth of one of the geared nuts 41 or 42. In the embodiment shown in FIGS. 5 and 6, the pinion gear 32 is engaged with the geared nut 41 or 42 by sliding the drive shaft 30 upwards along its axis thereby raising or lowering the pinion gear 32 to a proper height for alignment with the geared nut 41 or 42. In the embodiment shown in FIGS. 5 and 6, the optional thumb screw 33 is provided to lock the pinion gear 32 into position at the desired level such that the pinion gear 32 is securely interlocked with the geared nut 41 or 42. In addition, the drive shaft 30 of the current invention may also comprise a visual indicator disposed such that a visual signal is provided to the operator when the pinion gear 32 is properly positioned to interlock the geared nuts 41 or 42.

Although in the embodiment of the present invention described above, the pinion gear 32 is moved in a vertical direction by a manual force applied by an operator, any method of moving the pinion gear 32 may be utilized to raise or lower the pinion gear 32 into engagement with the geared nuts 41 or 42. In one alternative embodiment of the present invention, a hydraulic cylinder is utilized to automatically raise and lower the pinion gear 32 on the drive shaft 30. In yet another embodiment of the present invention, the pinion gear 32 is raised and lowered by pneumatic means. When raising and lowering the pinion gear 32 is accomplished by an automatic mechanism, control of the height of the pinion gear 32 and indication of the position of the pinion gear 32 may be accomplished by controls and indicator displays placed at any convenient location including upon portions of the drilling apparatus located remotely from the washpipe bonnet 14.

With the pinion gear 32 engaged with one of the geared nuts 41 or 42, the drive shaft 30 is rotated, in turn rotating the pinion gear 32 and in turn the engaged geared nut 41 or 42 with its corresponding connector, 25 or 29, respectively. In this manner, the geared nut 41 or 42 threadedly connects the washpipe assembly 34 to its corresponding connector, 25 or 29, respectively on either the gooseneck 15 or mainshaft 16 and tightens the nut 41 or 42 to its operating torque, such that the dynamic seal 49 disposed within the washpipe assembly 34 is engaged to create the sealed fluid conduit 23 between the main shaft 16 and the gooseneck 15.

Figure 4:
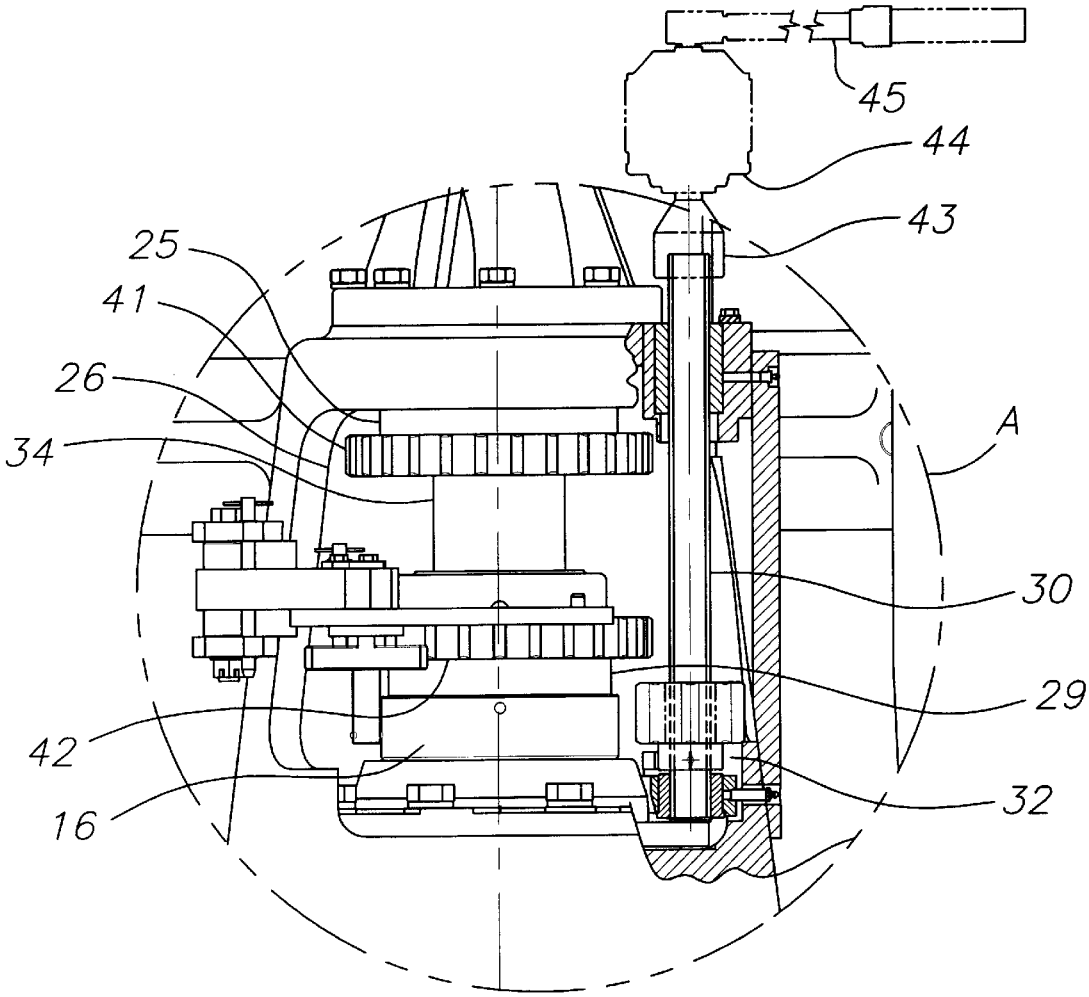
FIG. 4 is an enlarged front view of detail A from FIG. 3 showing a torque driver and a torque transfer mechanism for installing the washpipe assembly of FIG. 3.

As described previously, the drive shaft 30 may be rotated by any of a number of means known in the art. FIG. 4 illustrates an embodiment of the present invention in which a torque multiplier 44 is attached to the top of the drive shaft 30 through the socket adapter 43 and the manual torque wrench 45 is attached above the torque multiplier 44. In this embodiment, the torque wrench 45 is used to rotate the drive shaft 30. In embodiments that comprises the manual torque wrench 45 and the torque multiplier 44, the threaded connections between the geared nuts 41 and 42 and their corresponding connectors, 25 and 29, respectively are engaged by an operator applying a force to the manual torque wrench 45 thereby creating an input torque. The input torque is multiplied by the torque multiplier 44 and then applied as a larger output torque through the drive shaft 30 and pinion gear 32 to the geared nut 41 or 42 (previously engaged as described above) on the washpipe assembly 34. The pinion gear 32 applies the output torque to the engaged geared nut 41 or 42, causing the geared nut 41 or 42 to rotate against its corresponding connector, 25 or 29, respectively. As the geared nut 41 or 42 tightens against its corresponding connector, 25 or 29, respectively, the operator applies increasing force until the manual torque wrench 45 indicates that the desired operating torque for the geared nut 41 or 42 has been reached. The torque wrench 45 (shown in FIGS. 7E and 7F) typically indicates that the desired torque has been reached by producing an audible clicking sound or providing a readout indicating the current applied torque. Although any torque suitable for the specific connection may be applied, in one exemplary embodiment, the operator may apply a force to the manual torque wrench 45 which produces an input torque of up to about 125 ft-lbs. The torque multiplier 44 then converts this level of input torque to an output torque of about 7500 ft-lbs. It will be apparent that the above-referenced torques are only exemplary and that a wide range of input and output torques are contemplated by the present invention and that the suitable torque level will depend on the type of connection being made.

Another possible embodiment, as shown in FIG. 8 caps the drive shaft 30 with a motor coupling 51 and a motor 50. The motor 50 is attached to the washpipe bonnet 14 or TDS motor housing 17 in a manner that allows the motor 50 to impart a rotational force to the drive shaft 30 without itself experiencing rotation. The motor 50 may be an electric motor, hydraulic motor or air motor. The torque applied by the motor may be controllable via conventional mechanisms located locally or remotely. The motor 50 allows connections between the geared nuts 41 and 42 and their corresponding connectors, 25 and 29, respectively to be engaged and disengaged by means of rotational forces imparted to the drive shaft 30 by the motor 50. The motor 50 may be removably or permanently attached to any convenient mounting point such that the body of the motor 50 is not free to rotate as the shaft of the motor imparts rotational forces to the drive shaft 30. The motor 50 may be manually operated by a control mechanism such as, for example, a toggle switch located nearby or in a convenient remote location.

The embodiment shown in FIGS. 9A to 9C employs the hydraulic cylinder 60 connected to the connective means 61, such as an arm. The hydraulic cylinder 60 is operated by a hand pump or powered hydraulic pump and applies a force to the connective means 61 which, in turn, imparts a rotational force to the drive shaft 30. In the embodiment shown in FIGS. 9A to 9C, one end of the hydraulic cylinder 60 is removably attached to an anchoring point such as, for example, the external surface of the washpipe bonnet 14, while the opposite end of the hydraulic cylinder 60 is rotatively attached to one end of an arm 61. The opposite end of the arm 61 is attached to the top of the drive shaft 30 in such a manner that a linear force from the hydraulic cylinder 60 applied to the first end of the connective means 61 produces a rotational force in the drive shaft 30. The rotational force is then transmitted from the drive shaft 30 to the pinion gear 32 and in turn to the engaged geared nut 41 or 42 thereby allowing for the engaging or disengaging of the threaded connection between the geared nut 41 or 42 its corresponding connector, 25 or 29, respectively.

Although the above embodiments all describe a washpipe assembly 34 in which a controlled torque is applied to the connections via a separate pinion gear 32 and drive shaft 30, it should be understood that any mechanism capable of coupling a controllable torque applicator to the washpipe assembly 34 to engage or disengage the connections between the washpipe assembly nuts 41 and 42 and the gooseneck 15 and main shaft 16 could be utilized in the present invention.

For example, FIGS. 10A to 10C depict another possible embodiment of the present invention. This embodiment does not require the drive shaft 30, pinion gear 32 or separate driving mechanism as did each of the previously described embodiments. In this embodiment, a torqueing sleeve 70 comprising a sleeve of metal is designed to engage the nuts 41 and 42 and is slidably disposed around the outside of the washpipe assembly 34. In this embodiment, the entire washpipe assembly 34 with the torque sleeve 70 disposed thereon is placed into the bonnet opening 26 of the washpipe bonnet 14. The placement of the washpipe assembly 34 into the washpipe bonnet 14 may be accomplished using the optional pivot link 39 and positioning yoke and 36 as described above, or the washpipe assembly 34 may be inserted manually into the bonnet 14.

Once the torqueing sleeve 70 is in position, a lug wrench 71 is removably attached around the torqueing sleeve 70 such that the elongated portion of the wrench 71 extends along the bonnet casting edge between a make up shear pin 72*a* and a break out shear pin 72*b*. In this embodiment, engaging the packing box nut 42 and the main shaft 16 begins by manually rotating the packing box nut 42 until its threads engage the threads of the threaded main shaft connection 29 of the main shaft 16 and the connection becomes snug. The torqueing sleeve 70 is then engaged with the packing box nut 42, such that the packing box nut 42 is prevented from rotating. With the torqueing sleeve 70 and lug wrench 71 attached as described above, the TDS motor torque is set to about 10,000 ft-lbs and used to rotate the main shaft 16 relative to the washpipe assembly 34, such that the threaded connection between the packing box nut 42 and the main shaft 16 is tightened. A similar procedure is used to engage the connection between the threaded gooseneck connection 25 of the gooseneck 15 and gooseneck nut 41 with the exception that the torqueing sleeve 70 must be secured against gravity. This may be accomplished by the use of any convenient fastening means, for example, a pair of locking screws (not shown). With the torqueing sleeve 70 secured in position the TDS motor torque is set to about 7,000 ft-lbs and the main shaft slowly rotated to make engage the threaded gooseneck connection 25 of the gooseneck 15 and the gooseneck nut 41.

Although the discussion of a method of utilizing the washpipe assembly 34 of the current invention has focused on engaging the washpipe assembly 34 and the main shaft 16 and/or the gooseneck 15, it will be understood that a method identical in each regard save the direction of the torque applied to the washpipe assembly nuts 41 and 42 may be utilized to disengage the connections. Note in an the embodiment described above in which the TDS motor is utilized to apply torque to the washpipe assembly nuts 41 and 42, the gooseneck connection must be disengaged first as less torque is applied thereto during the engagement procedure. The torque applied thereto is backed up against the nut 42 which is engaged to about 10,000 ft/lbs.

Though several embodiments of the present invention have been described herein, it will be apparent to those skilled in the art that these are but a few of many possible incarnations of the present invention.

What is claimed is:

1. A drilling system comprising:

a first rotatable tubular connector;

a second non-rotatable tubular connector;

a washpipe assembly comprising at least one dynamic seal and defining a fluid conduit having at one end a first mating connector and at another end a second mating connector designed to interconnect with the first and second tubular connectors; and a controllable torque driver arranged to mechanically engage the washpipe assembly such that fluid connections are made between the first mating connector and the first tubular connector, and the second mating connector and the second tubular connector.

2. The drilling system of claim 1, wherein the controllable torque driver is selected from the group consisting of a torque wrench, a torque drive motor, a hydraulic cylinder, and a torqueing sleeve.

3. The drilling system of claim 2, wherein the torque drive motor is selected from the group consisting of a air motor, a hydraulic motor, and an electric motor.

4. The drilling system of claim 1, further comprising a positioning mechanism for moving the washpipe assembly between a washpipe assembly connecting position and a washpipe assembly replacement position.

5. A drilling system comprising:

a first rotatable tubular connector;

a second non-rotatable tubular connector;

a washpipe assembly comprising at least one dynamic seal and defining a fluid conduit having at one end a first geared nut and at another end a second geared nut designed to interconnect with the first and second tubular connectors;

a drive shaft having a pinion gear for engaging the first and second geared nuts; and a controllable and reproducible torque driver attached to the drive shaft, such that fluid connections are made between the first geared nut and the first tubular connector, and the second geared nut and the second tubular connector by manipulation of the drive shaft.

6. The drilling system of claim 5, wherein the controllable and reproducible torque driver is selected from the group consisting of a torque wrench, a torque drive motor, a hydraulic cylinder, and a torqueing sleeve.

7. The drilling system of claim 6, wherein the torque drive motor is selected from the group consisting of an air motor, a hydraulic motor, and an electric motor.

8. The drilling system of claim 5, further comprising a positioning mechanism for moving the washpipe assembly between a washpipe assembly connecting position and a washpipe assembly replacement position.

9. The drilling system of claim 8, wherein the positioning mechanism comprises a positioning yoke and a pivot link.

10. The drilling system of claim 9, wherein the pivot link comprises a jack nut and a jack screw that combine to allow the positioning yoke to move vertically along a path defined by the length of the jack screw.

11. The drilling system of claim 5, wherein the drive shaft pinion gear is movable along the drive shaft, such that the pinion may be brought into and out of engagement with each of the first geared nut and the second geared nut.

12. The drilling system of claim 11, wherein a hydraulic cylinder moves the drive shaft pinion gear along the drive shaft, such that the pinion may be brought into and out of engagement with each of the first geared nut and the second geared nut.

13. The drilling system of claim 11, wherein a pneumatic means moves the drive shaft pinion gear along the drive shaft, such that the pinion may be brought into and out of engagement with each of the first geared nut and the second geared nut.

14. The drilling system of claim 5, wherein the first rotatable tubular connector is a main shaft connected to a drill string, and the second non-rotatable tubular connector is a gooseneck assembly connected to a drilling mud supply.

15. A drilling system comprising:

a first rotatable tubular connector;

a second non-rotatable tubular connector;

a washpipe assembly comprising at least one dynamic seal and defining a fluid conduit having at one end a first geared nut and at another end a second geared nut designed to interconnect with the first and second tubular connectors;

a controllable and reproducible torque driver for transmitting a torque from the first rotatable tubular connector to the washpipe assembly.

16. The drilling system of claim 15, wherein the controllable and reproducible torque driver comprises a torqueing sleeve for engaging the first rotatable tubular connector and a wrench connected to the torqueing sleeve for engaging the washpipe assembly.

17. The drilling system of claim 15, wherein the controllable and reproducible torque driver comprises a torqueing sleeve and a wrench that are movable from a first position to a second position, wherein in the first position the torqueing sleeve engages the first rotatable tubular connector and the wrench engages the first geared nut to transfer a torque from the first rotatable tubular connector to the first geared nut to connect the washpipe assembly to the first rotatable tubular connector, and wherein in the second position the torqueing sleeve engages the washpipe assembly and the wrench engages the second geared nut to transfer a torque from the first rotatable tubular connector to the second geared nut to connect the washpipe assembly to the second non-rotatable tubular connector.

18. A method of connecting a washpipe assembly in a drill system comprising:

providing a first rotatable tubular connector;

providing a second non-rotatable tubular connector;

providing a washpipe assembly comprising at least one dynamic seal and defining a fluid conduit having at one end a first mating connector and at another end a second mating connector designed to interconnect with the first and second tubular connectors; and applying a controllable torque to the first and second mating connectors such that fluid connections are made between the first mating connector and the first tubular connector, and the second mating connector and the second tubular connector.

19. The method of claim 18, further comprising providing a controllable torque driver for applying the controllable torque to the first and second connectors, wherein the controllable torque driver is selected from the group consisting of a torque wrench, a torque drive motor, a hydraulic cylinder, and a torqueing sleeve.

20. The method of claim 18, further comprising providing a controllable torque drive motor for applying the controllable torque to the first and second connectors, wherein the controllable torque drive motor is selected from the group consisting of an air torque drive motor, a hydraulic torque drive motor, and an electric torque drive motor.

21. The method of claim 18, further comprising providing a positioning mechanism for moving the washpipe assembly between a washpipe assembly connecting position and a washpipe assembly replacement position.

22. A method of connecting a washpipe assembly in a drill system comprising:

providing a first rotatable tubular connector;

providing a second non-rotatable tubular connector;

providing a washpipe assembly comprising at least one dynamic seal and defining a fluid conduit having at one end a first geared nut and at another end a second geared nut designed to interconnect with the first and second tubular connectors;

providing a drive shaft having a pinion gear for engaging the first and second geared nuts; and applying a controllable and reproducible torque to the drive shaft, such that fluid connections are made between the first geared nut and the first tubular connector, and the second geared nut and the second tubular connector by manipulation of the drive shaft.

23. The method of claim 22, further comprising providing a controllable and reproducible torque driver for applying the controllable and reproducible torque to the drive shaft, wherein the controllable and reproducible torque driver is selected from the group consisting of a torque wrench, a torque drive motor, a hydraulic cylinder, and a torqueing sleeve.

24. The method of claim 22, further comprising providing a controllable and reproducible torque drive motor for applying the controllable and reproducible torque to the drive shaft, wherein the controllable and reproducible torque drive motor is selected from the group consisting of an air torque drive motor, a hydraulic torque drive motor, and an electric torque drive motor.

25. The method of claim 22, further comprising providing a positioning mechanism for moving the washpipe assembly between a washpipe assembly connecting position and a washpipe assembly replacement position.

26. The method of claim 25, wherein the positioning mechanism comprises a positioning yoke and a pivot link.

27. The method of claim 26, wherein the pivot link comprises a jack nut and a jack screw that combine to allow the positioning yoke to move vertically along a path defined by the length of the jack screw.

28. The method of claim 22, further comprising moving the drive shaft pinion gear along the drive shaft, such that the pinion may be brought into and out of engagement with each of the first geared nut and the second geared nut.

29. The method of claim 28, further comprising providing a hydraulic cylinder to move the drive shaft pinion gear along the drive shaft, such that the pinion may be brought into and out of engagement with each of the first geared nut and the second geared nut.

30. The method of claim 28, further comprising providing a pneumatic means to move the drive shaft pinion gear along the drive shaft, such that the pinion may be brought into and out of engagement with each of the first geared nut and the second geared nut.

31. The method of claim 22, wherein the first rotatable tubular connector is a main shaft connected to a drill string, and the second non-rotatable tubular connector is a gooseneck assembly connected to a drilling mud supply.

32. A method of connecting a washpipe assembly in a drill system comprising:

providing a first rotatable tubular connector;

providing a second non-rotatable tubular connector;

providing a washpipe assembly comprising at least one dynamic seal and defining a fluid conduit having at one end a first geared nut and at another end a second geared nut designed to interconnect with the first and second tubular connectors; and transmitting a torque from the first rotatable tubular connector to the washpipe assembly, such that fluid connections are made between the first geared nut and the first tubular connector, and the second geared nut and the second tubular connector.

33. The method of claim 32, wherein transmitting a torque from the first rotatable tubular connector to the washpipe assembly comprises transmitting a torque from the first rotatable tubular connector to the first geared nut, such that a fluid connect is made between the first geared nut and the first tubular connector; and transmitting a torque from the first rotatable tubular connector to the second geared nut, such that a fluid connect is made between the second geared nut and the second tubular connector.

34. The method of claim 33, wherein transmitting a torque from the first rotatable tubular connector to the first geared nut comprises connecting a torqueing sleeve to the first rotatable tubular connector and connecting a wrench that is attached to the torqueing sleeve to the first geared nut; and wherein transmitting a torque from the first rotatable tubular connector to the second geared nut comprises connecting the torque sleeve to the washpipe assembly, when the washpipe assembly is connected to the first rotatable tubular connector and connecting the wrench to the second geared nut.

* * * * *